US006746289B2

(12) United States Patent
Nakajima

(10) Patent No.: US 6,746,289 B2
(45) Date of Patent: Jun. 8, 2004

(54) PERSONAL WATERCRAFT

(75) Inventor: Jun Nakajima, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/282,101

(22) Filed: Oct. 29, 2002

(65) Prior Publication Data

US 2003/0129889 A1 Jul. 10, 2003

(30) Foreign Application Priority Data

Oct. 30, 2001 (JP) ..... 2001-333286

(51) Int. Cl.[7] ..... B63H 21/38
(52) U.S. Cl. ..... 440/88 A
(58) Field of Search ..... 440/88 A, 88 R; 114/55.57

(56) References Cited

U.S. PATENT DOCUMENTS 5,957,072 A * 9/1999 Hattori ..... 114/55.57
6,447,351 B1 * 9/2002 Nanami ..... 440/88 R
2003/0008571 A1 * 1/2003 Matsuda et al. ..... 440/38
2003/0129887 A1 * 7/2003 Nakajima ..... 440/88 A
2003/0134546 A1 * 7/2003 Nakajima et al. ..... 440/88 A

OTHER PUBLICATIONS

Patent Abstracts of Japan Publication No. 08048287 A; Feb. 20, 1996; Nitta Shigemitsu et al.; "Compact Planing Boat".*

* cited by examiner

*Primary Examiner*—Sherman Basinger
(74) *Attorney, Agent, or Firm*—Birch, Stewart, Kolasch & Birch, LLP

(57) ABSTRACT

To provide a personal watercraft in which it can be ensured that air funnels are comparatively long in the condition where the spacing between left and right side walls of a watercraft body is suppressed to a minimum. A personal watercraft has a structure in which a saddle ride type seat is provided at a roughly central portion of a watercraft body. Left and right side walls extend downwards from left and right lower edges of the seat. An engine is mounted on the lower side of the seat and is directed in the front-rear direction of the watercraft body. Cylinders provided in the engine are arranged in the front-rear direction of the watercraft body. First to fourth intake pipes in communication with the cylinders extend from a side surface of the engine. The first to fourth intake pipes are bent along the left side wall on the lower side of the seat.

19 Claims, 12 Drawing Sheets

PERSONAL WATERCRAFT

CROSS-REFERENCE TO RELATED APPLICATIONS

This nonprovisional application claims priority under 35 U.S.C. § 119(a) on patent application Ser. No. 2001-333286 filed in Japan on Oct. 30, 2001, the entirety of which is hereby incorporated by reference.

BACKGROUND OF THE INVENTION

1. Field of the Invention

The present invention relates to a personal watercraft which includes a saddle ride type seat at a roughly central portion of a watercraft body. An engine is mounted on the lower side of the seat and is directed in the front-rear direction of the watercraft body. Furthermore, intake pipes are in communication with a plurality of cylinders provided in the engine, respectively. Each of the intake pipes extend from a side surface of the engine.

2. Description of Background Art

A personal watercraft is disclosed, for example, in Japanese Patent Laid-open No. Hei 8-48287 entitled "PERSONAL PLANING WATERCRAFT". FIG. 1 of the above publication has been reproduced as FIG. 13 of the present specification. It should be noted that the reference numerals have been re-assigned to avoid confusion with FIGS. 1–12 of the present invention.

FIG. 13 is a sectional view of a personal watercraft according to the background art. The personal watercraft 100 has a structure in which left and right side walls 102 and 103 are provided at a roughly central portion of a deck 101. A saddle ride type seat 104 is provided at the upper ends of the left and right side walls 102 and 103. An engine 105 is provided on the lower side of the seat 104 and is directed in the front-rear direction of a watercraft body 106. Cylinders 105*a* of the engine 105 are inclined to the right side, to open a large space 107 on the left side of the engine 105. Furthermore, intake system equipment 108 is provided in the left-side space 107, whereby the intake system equipment 108 is prevented from projecting a large amount to the left side from the center 106*a* of the watercraft body 106.

With the intake system equipment 108 prevented from projecting a large amount to the left side from the center 106*a* of the watercraft body 106, the spacing between the left and right side walls 102 and 103 of the deck 101 can be suppressed to a minimum. Therefore, when the driver sits astride the saddle ride type seat 104 and put his feet on foot rest portions 101*a*, 101*a* of the deck 101, the driver can maintain a natural posture.

Incidentally, the intake system equipment 108 has a structure in which an intake silencer 108*b* is in communication with the cylinders 105*a* through air funnels 108*a*. An intake pipe 108*c* is in communication with the intake silencer 108*b*.

According to the intake system equipment 108, air sucked into the intake pipe 108*c* through a suction port 108*d* of the intake pipe 108*c* can be led into the intake silencer 108*b*. The air led into the intake silencer 108*b* can be introduced into the cylinders 105*a* through the air funnels 108*a*.

The engine 105 mounted on the personal watercraft 100 in some cases has a structure in which the air funnels 108*a* are set to have a certain length for efficient intake of air into the cylinders 105*a*. In this case, the air funnels 108*a* project a large amount to the left side from the center 106*a* of the watercraft body 106. In order to contain the projecting air funnels 108*a* in the inside of the left side wall 102, the left side wall 102 must project a large amount from the center 106*a* of the watercraft body 106. Therefore, when the driver sits astride the saddle ride type seat 104, a foot portion of the driver interferes with the left side wall 102, and the driver cannot sit astride the seat 104 in a natural posture.

In addition, sea water or water may penetrate into the watercraft body during an operation of the personal watercraft. Once sea water or water has penetrated into the watercraft body, the sea water or water may penetrate into the cylinders 105*a* through the air funnels 108*a*. Therefore, it has been desired to put into practical use a personal watercraft 100 which can prevent sea water or water from penetrating into the cylinders 105*a*, even if sea water or water penetrates into the watercraft body 106.

SUMMARY OF THE INVENTION

Accordingly, it is an object of the present invention to provide a personal watercraft which can secure comparative long air funnels in the condition where the spacing between left and right side walls of the watercraft body is suppressed to be small, and which can prevent sea water or water from penetrating into an engine even if sea water or water should have penetrated into the watercraft body.

In order to solve the above-mentioned problems, a first aspect of the present invention is directed to a personal watercraft including a saddle ride type seat at a roughly central portion of a watercraft body. Cover form side walls extend downwards from left and right lower edges of the seat. An engine is mounted on the lower side of the seat with the axis of a crankshaft thereof directed in the front-rear direction of the watercraft body. A plurality of cylinders is provided in the engine. The cylinders are arranged in the front rear direction of the watercraft body. Intake pipes are in communication with the cylinders, respectively. Each of the intake pipes extend from a side surface of the engine, wherein each of the intake pipes is bent along the side wall on the lower side of the seat.

With the intake pipes bent along the side wall on the lower side of the seat, the intake pipes can extend upwards a large amount without projecting the side wall on the lower side of the seat toward the outside. Accordingly, the spacing between the left and right side walls on the lower side of the seat can be suppressed to a minimum. Therefore, the driver can sit astride the saddle ride type seat in a natural posture.

In addition, since the intake pipes can extend a large amount upwards, the inlets of the intake pipes can be disposed at high positions. Accordingly, sea water or water can be prevented from reaching the inlets of the intake pipes, even if sea water or water penetrates into the watercraft body. Therefore, it is possible to prevent sea water or water from penetrating into the intake pipes through the inlets of the intake pipes.

According to a second aspect of the present invention, inlets of the intake pipes are arranged in a zigzag manner such that the inlets are arranged densely. The intake pipes are surrounded by an air box disposed between the engine and the side wall.

With the inlets of the intake pipes arranged in a zigzag manner, the inlets of the intake pipes can be arranged densely with respect to the front-rear direction of the watercraft body. Therefore, the air box can be made compact, so that the air box can be disposed at a desired position in the watercraft body even where the intake pipes are extended a large amount upwards. Therefore, the spacing between the left and right side walls on the lower side of the seat can be suppressed to a minimum, so that the driver can sit astride the saddle ride type seat in a natural posture.

According to a third aspect of the present invention, the intake pipes extend upwards.

With each of the intake pipes extending upwards, the inlets of the intake pipes can be disposed at high positions. Accordingly, it can be ensured that sea water or water does not easily reach the inlets of the intake pipes, even if sea water or water penetrates into the watercraft body.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
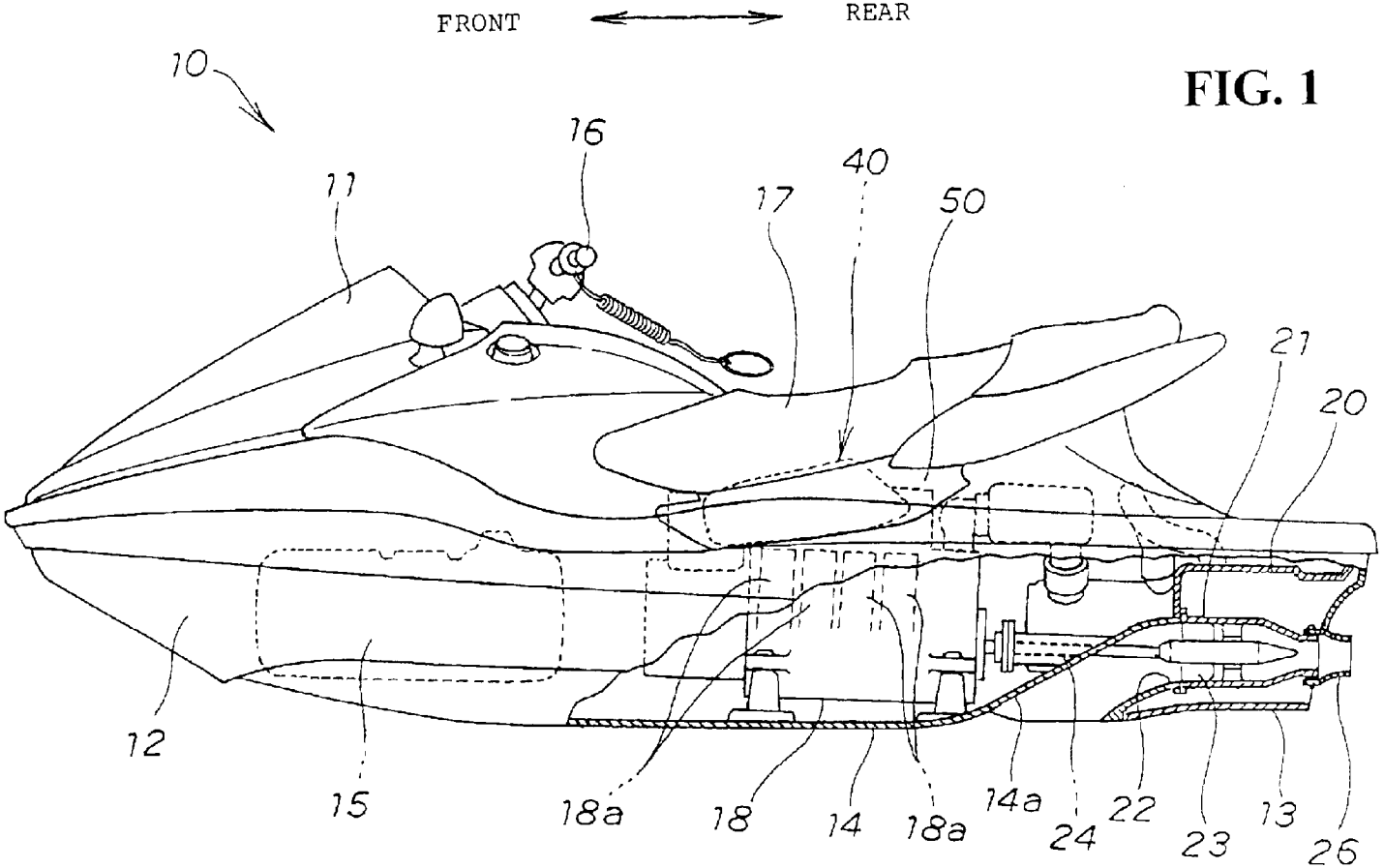
FIG. 1 is a side view of a personal watercraft according to the present invention.

An embodiment of the present invention will now be described with reference to the accompanying drawings. The drawings should be viewed in the direction of orientation of the reference numerals.

FIG. 1 is a side view of a personal watercraft according to the present invention. The personal watercraft 10 is a jet propulsion watercraft in which a fuel tank 15 is fitted to a front portion 12 of a watercraft body 11. A steering handle 16 is provided on the upper side of the fuel tank 15. A saddle ride type seat 17 is provided on the rear side of the steering handle 16. An engine 18 is provided on the lower side of the seat 17. A jet propeller chamber 20 is provided at a stern 13 on the rear side of the engine 18. A jet propeller 21 is provided in the jet propeller chamber 20.

The jet propeller 21 includes a housing 22 extending rearwards from an inlet 14*a* at a watercraft bottom 14. An impeller 23 is rotatably fitted in the housing 22. Furthermore, the impeller 23 is connected to a drive shaft 24 of the engine 18. With the impeller 23 rotated by the engine 18, water is sucked in through the inlet 14*a* at the watercraft bottom 14, and the water thus sucked in is led through the housing 22 to a steering nozzle 26 as jet water. The jet water led to the steering nozzle 26 is jetted from the steering nozzle 26, whereby the personal watercraft 10 can be propelled.

Figure 2:
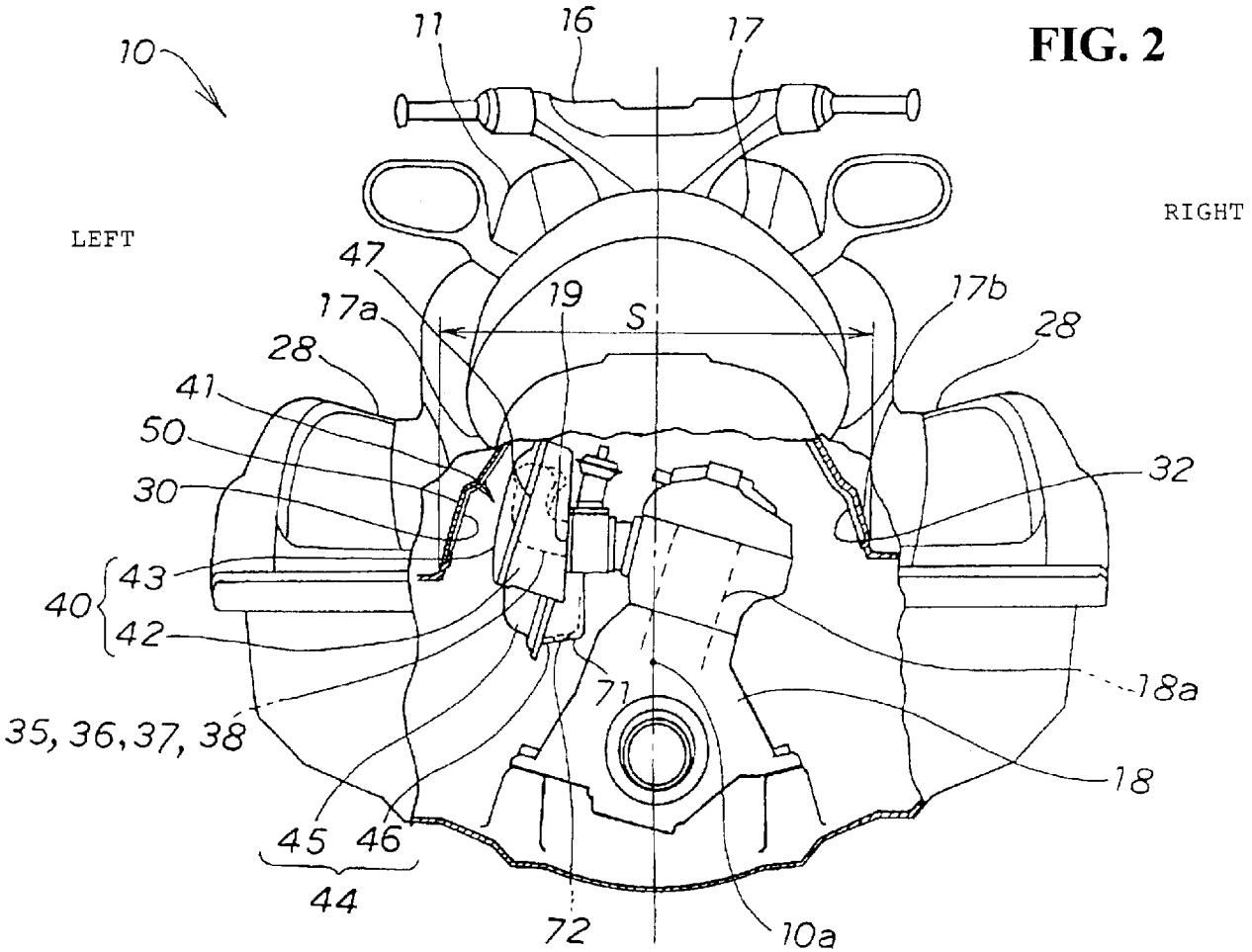
FIG. 2 is a rear elevation showing a major part of the personal watercraft according to the present invention.

FIG. 2 is a back elevation showing a major part of the personal watercraft according to the present invention. The personal watercraft 10 has a structure in which the saddle ride type seat 17 is provided at a roughly central portion of the watercraft body 11. Cover form left and right side walls 30 and 32 extend downwards from left and right lower edges 17*a* and 17*b* of the seat 17. The engine 18 is mounted on the lower side of the seat 17 with the axis of a crankshaft thereof directed in the front-rear direction of the watercraft body 11 (See also FIG. 1). A plurality of cylinders 18*a* (See also FIG. 1) provided in the engine 18 are arranged in the front-rear direction of the watercraft body 11. Intake pipes (namely, air funnels) 35, 36, 37, 38 in communication with the cylinders 18*a*, respectively, extend from a side surface 19 of the engine 18. Furthermore, an air box 40 for containing the intake pipes 35–38 is provided in a space 41 between the engine 18 and the left side wall (side wall) 30.

With the engine 18 inclined to the right side of the watercraft body 11, it can be ensured that the space 41 between the engine 18 and the left side wall 30 is large. With the intake pipes 35–38 and the air box 40 provided in this space 41, the intake pipes 35–38 and the air box 40 can be prevented from projecting a large amount to the left side from the center 10*a* of the watercraft body 11.

Therefore, the spacing S between the left and right side walls 30 and 32 can be suppressed to a minimum, so that the driver can maintain a natural operating posture when he sits astride the saddle ride type seat 17 and put his feet on foot rest portions 28, 28 of the deck.

In addition, the air box 40 includes a box main body 42 fitted to the engine 18. A cover body 43 is detachably fitted to the box main body 42. A bulged portion 44 is provided at a front portion of the box main body 42. The air box 40 is disposed with the cover body 43 opposed to the left side wall 30 of the watercraft body 11. The bulged portion 44 includes a support frame 45 formed integrally with the front portion of the box main body, and a bulged cover 46 detachably fitted to the support frame 45. In addition, a fitting surface 47 of the box main body 42 for fitting the cover body 43 is formed to be substantially parallel to the left side wall 30.

Figure 3:
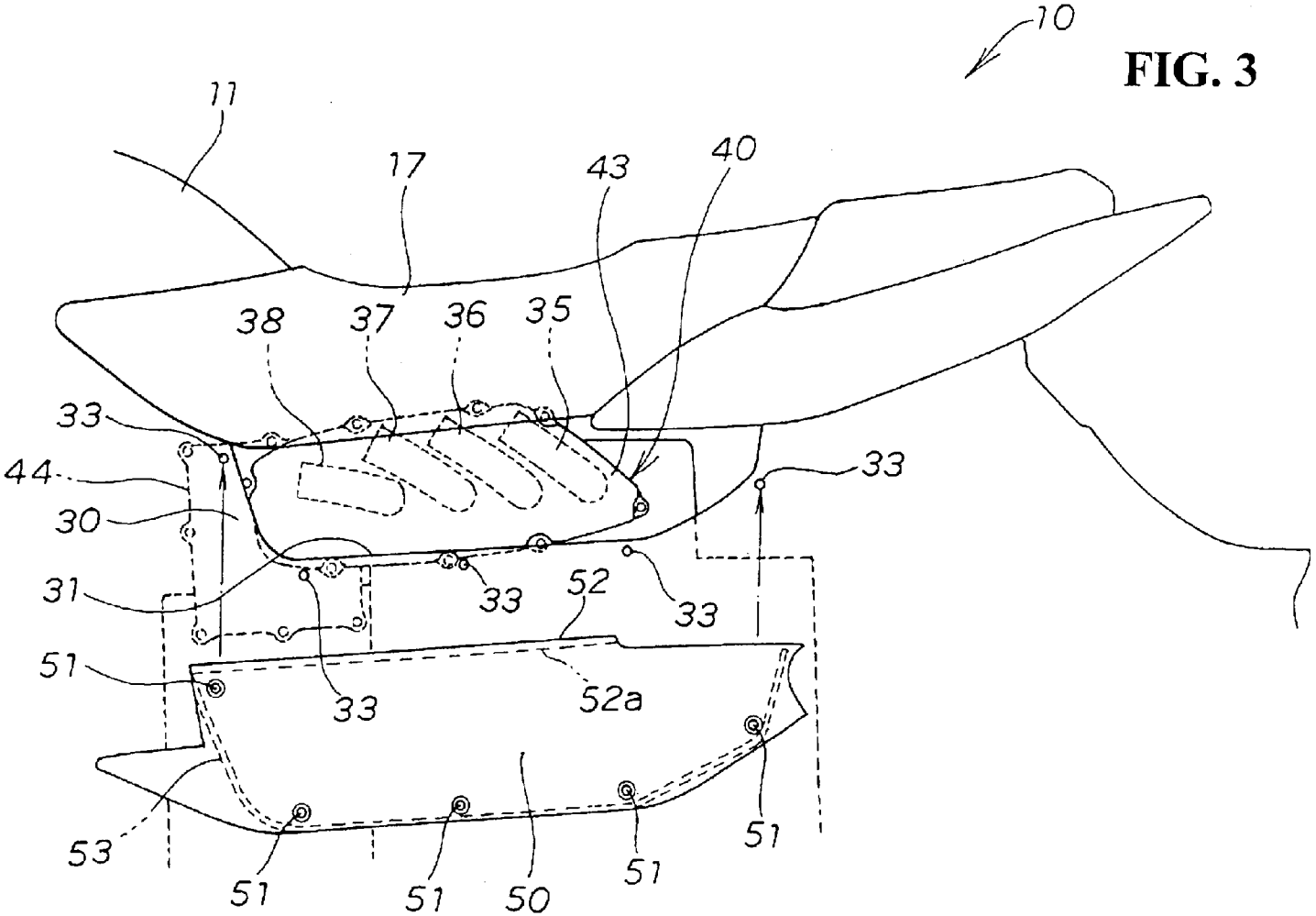
FIG. 3 is a side view showing a major part of the personal watercraft according to the present invention.

FIG. 3 is a side view showing a major part of the personal watercraft according to the present invention, and shows the condition where the left side wall (namely, the side wall on the lower side of the seat) 30 opposed to the cover body 43 is provided with an opening 31. A side cover 50 is provided to be capable of being fitted to and detached from the opening 31.

Bolts (not shown) are inserted into insertion holes 51 formed in a peripheral edge of the side cover 50. The bolts thus inserted into the insertion holes 51 are screw-connected into fitting holes 33 formed in the left side wall 30, whereby the side cover 50 can be fitted to the left side wall 30 to thereby close the opening 31.

On the other hand, with the bolts loosened and detached from the fitting holes 33, the side cover 50 can be detached from the left side wall 30 to thereby open the opening 31 in the left side wall 30. In addition, since the cover body 43 of the air box 40 is disposed facing to the left side wall 30, the left side wall 30 is provided with the opening 31 and the side cover 50 is provided to be capable of being fitted to and detached from the opening 31. The cover body 43 can be easily detached from the box main body 42 by utilizing the opening 31 which is opened by detaching the side cover 50 from the left side wall 30.

In order that the driver can easily sit astride the saddle ride type seat 17 of the personal watercraft 10, the width of the air box 40 must be small, but the side surface of the air box 40 can be secured to be comparatively large. Since the cover body 43 is disposed at the side surface of the air box 40, it can be ensured that the cover body 43 is large in shape. Thus, the cover body 43 can be easily detached, and a large opening can be opened in the box main body 42 by detaching the cover body 43. Accordingly, maintenance or inspection of the inside of the box main body 42 can be carried out easily.

Figure 4:
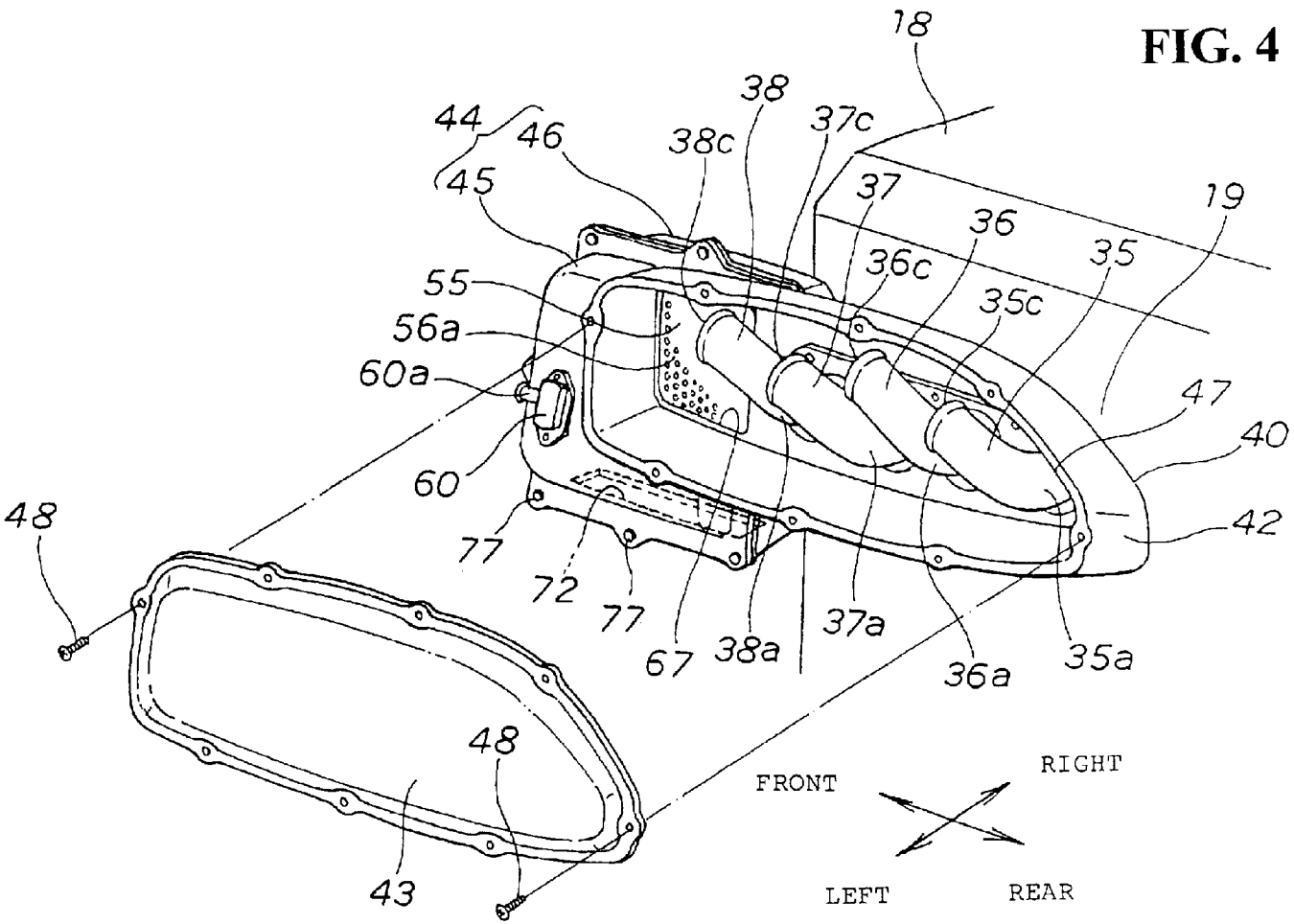
FIG. 4 is a perspective view showing a major part of the personal watercraft according to the present invention.

FIG. 4 is a perspective view showing a major part of the personal watercraft according to the present invention, and shows the condition where the four cylinders 18*a* provided in the engine 18 are arranged in the front-rear direction of the watercraft body 11 (shown in FIG. 1). The intake pipes 35–38 are in communication with the cylinders 18*a* and extend from the side surface 19 of the engine 18. The intake pipes 35–38 are contained in the box main body 42 of the air box 40. Furthermore, the cover body 43 is detached from the fitting surface 47 of the box main body 42.

Hereinafter, description will be made by referring to the intake pipes 35–38 as first to fourth intake pipes 35, 36, 37 and 38 in the order from the rear side toward the front side. At the time of fitting the cover body 43 to the box main body 42, the cover body 43 is brought into contact with the fitting surface 47 of the box main body 42. In this condition, bolts 48 are fastened, whereby the cover body 43 can be fitted to the box main body 42.

With the cover body 43 thus fitted to the box main body 42, the first to fourth intake pipes 35, 36, 37 and 38 can be covered with the cover body 43 onto the box main body 42. Therefore, it is possible to prevent sea water or water from splashing onto the first to fourth intake pipes 35, 36, 37 and 38.

By bending the first to fourth intake pipes 35–38 in the vicinity of base portions 35*a*–38*a* thereof, the intake pipes 35–38 can extend forwards with a rising gradient. Accordingly, it can be ensured that the lengths of the first to fourth intake pipes 35–38 is large, without projecting the first to fourth intake pipes 35–38 to the left side from the center 10*a* (shown in FIG. 1) of the watercraft body 10.

Figure 5:
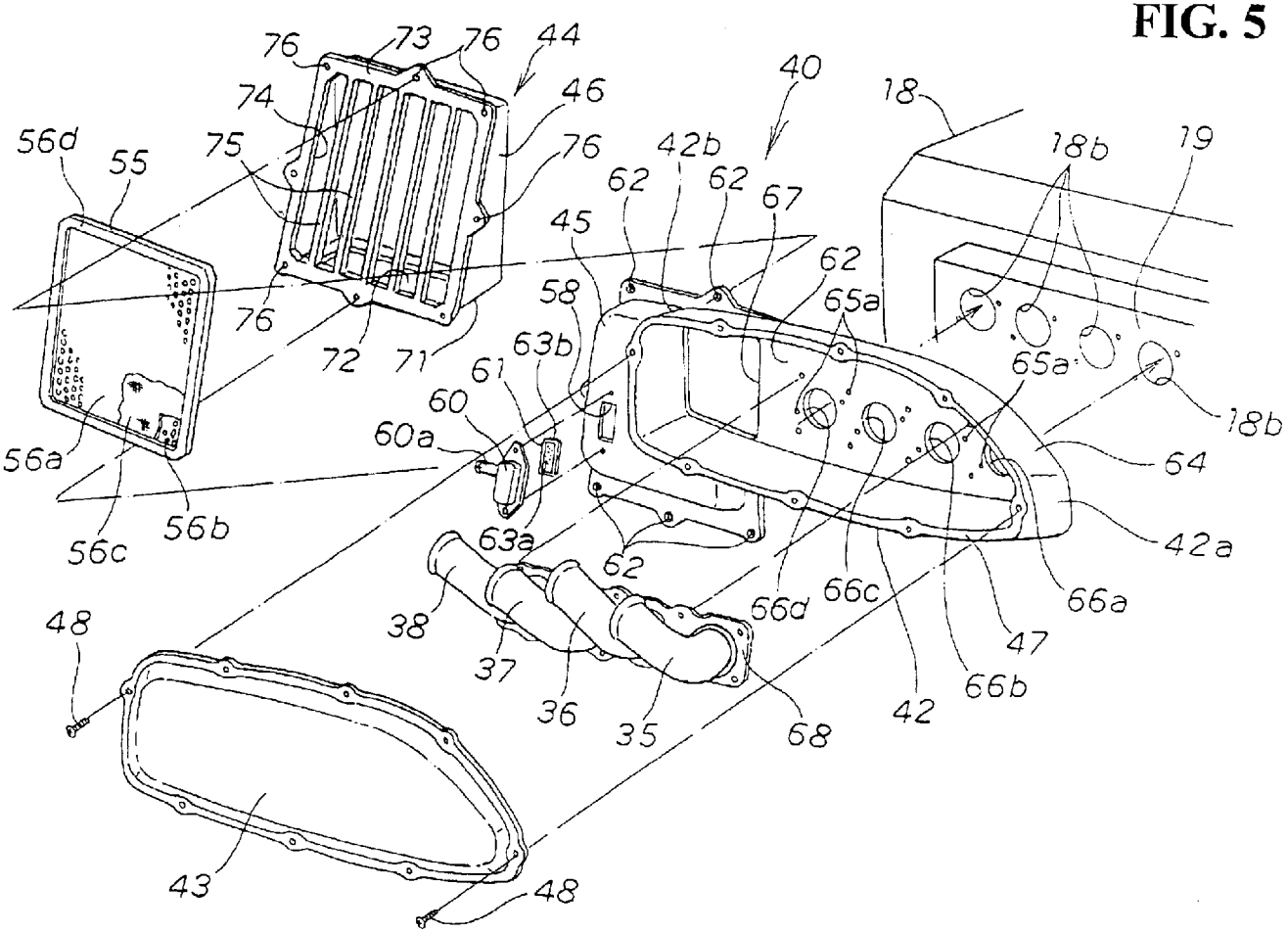
FIG. 5 is an exploded perspective view showing a major part of the personal watercraft according to the present invention.

FIG. 5 is an exploded perspective view showing a major part of the personal watercraft according to the present invention. The air box 40 includes the box main body 42 capable of being fitted to the side surface 19 of the engine 18 and containing the first to fourth intake pipes 35–38. The cover body 43 is capable of being fitted to and detached from the fitting surface 47 of the box main body 42. The support frame 45 is formed integrally with a front end portion of the box main body 42. The bulged cover 46 is capable of being fitted to and detached from the support frame 45, an intake trap 55 clamped between the support frame 45 and the bulged cover 46. Furthermore, a breather 60 is fitted to a breather opening 58 of the support frame 45. Incidentally, the support frame 45 and the bulged cover 46 constitute the bulged portion 44 as has been described above.

The box main body 42 has a structure in which an outer peripheral wall 64 is formed in a roughly rectangular shape. An inside end surface of the outer peripheral wall 64 on the side of the engine 18 is closed with an inner wall 62. An outside end surface (namely, fitting surface) 47 of the outer peripheral wall 64 on the side of the left side wall 30 (shown in FIG. 2) is set in an opened condition. An inner wall 65 is provided with first to fourth four insertion holes 66*a*–66*d* arranged in the order forwards from the rear end 42*a* of the box main body 42. Furthermore, the inner wall 65 is provided with a roughly rectangular air intake port 67 on the front side of the fourth insertion hole 66*d*.

The support frame 45 is bulged forwards from a front end portion 42*b* of the box main body 42 and includes a breather opening 58 for fitting the breather 60 and a breather trap 61 in the vicinity of the box main body 42. The support frame 45 also includes fitting holes 62 for fitting the bulged cover 46 along the outer periphery thereof.

According to the box main body 42, bolts (not shown) are inserted into fitting holes 65*a* of the inner wall 65. The box main body 42 is fitted to the side surface 19 of the engine 18 by the bolts. The respective base ends 35*a*–38*a* of the first to fourth intake pipes 35–38 are inserted into the first to fourth insertion holes 66*a*–66*d* of the inner wall 65. The respective base ends 35*a*–38*a* are inserted into intake ports 18*b* of the engine 18. In this condition, the first to fourth intake pipes 35–38 are fitted to the inner wall 65 by a fixing member 68.

Figure 6:
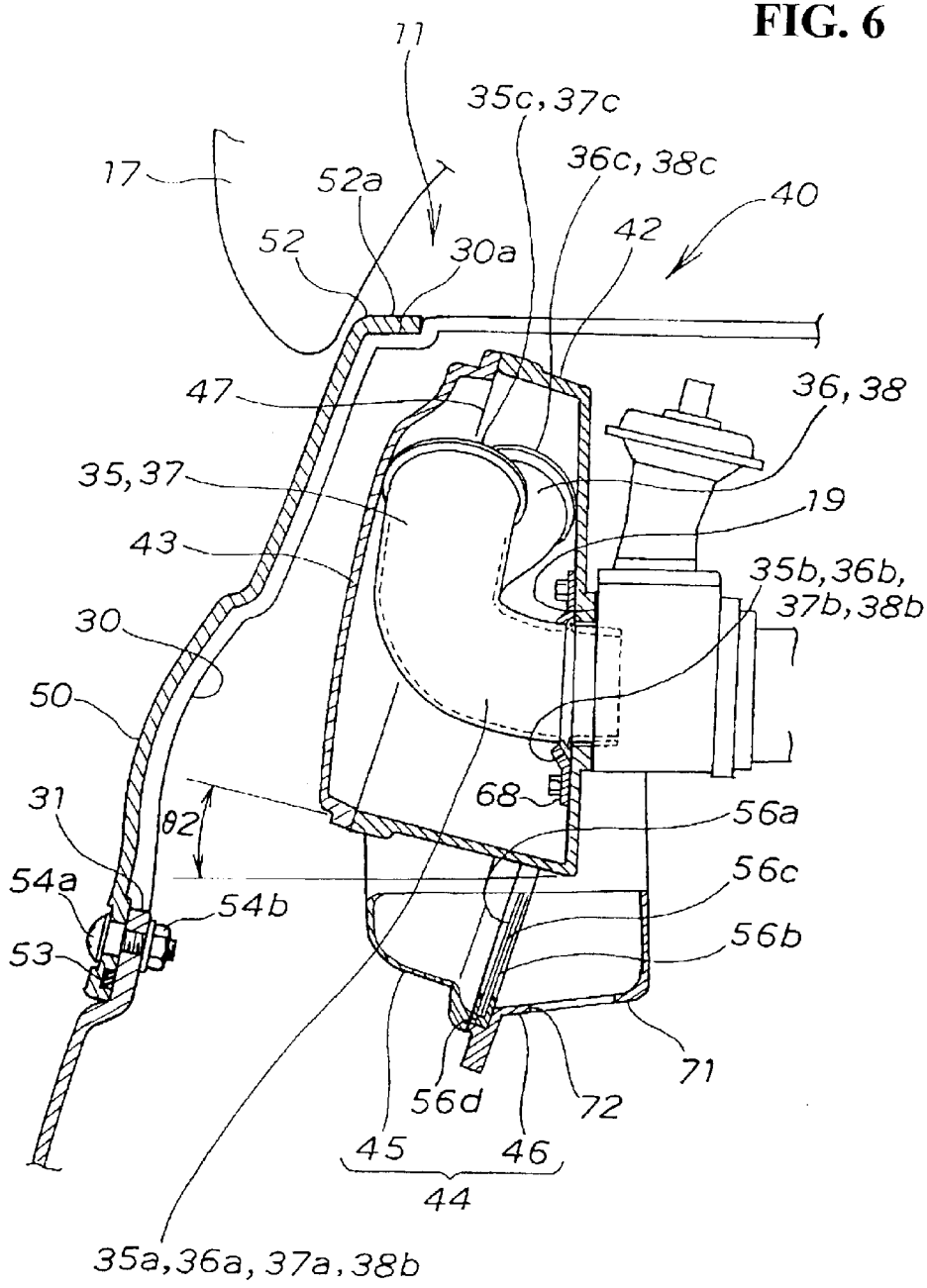
FIG. 6 is a sectional view showing a major part of the personal watercraft according to the present invention.

The base ends 35*a*–38*a* of the first to fourth intake pipes 35–38 are provided respectively with flanges 35*b*–38*b* (shown in FIG. 6). By pressing the flanges 35*b*–38*b* by the fixing member 68, the first to fourth intake pipes 35–38 can be fixed. With the first to fourth intake pipes 35–38 and the fixing member 68 thus provided as separate members, the first to fourth intake pipes 35–38 can be made simple in shape. Therefore, the first to fourth intake pipes 35–38 can be easily produced by blow molding, and the cost of the first to fourth intake pipes 35–38 can be suppressed.

On the other hand, ordinary intake pipes are generally provided with fixing members formed integrally with base ends thereof. Therefore, the intake pipes are complicated in shape, and cannot easily be produced by blow molding. Accordingly, it is difficult to suppress the cost of the ordinary intake pipes. Incidentally, the method of molding the first to fourth intake pipes 35–38 is not limited to the above-mentioned, and can also be produced by injection molding or other molding methods.

Furthermore, the bulged cover 46 is fitted in the condition where the intake trap 55 is clamped between it and the support frame 45 (See FIG. 4). The bulged cover 46 has a structure in which a lower portion 71 is bulged to the inside of the watercraft body 11 (shown in FIG. 12). The bulged cover 46 is formed in a roughly triangular shape in side view. The lower portion 71 is provided with a suction port 72. An opening 74 in a fitting surface 73 is provided with louvers 75 for supporting the intake trap 55. Furthermore, the fitting surface 73 is provided at its outer periphery with fitting holes 76 opposed to the fitting holes 62 of the support frame 45.

The intake trap 55 is, for example, a rectangular member in which a metal mesh net 56*c* (See also FIG. 6) is clamped between two sheets of punching metals 56*a*, 56*b*. The punching metals 56*a*, 56*b* and the metal mesh net 56*c* are fitted as one body by a frame body 56*d*. Therefore, by inserting bolts 77 (shown in FIG. 4) into the fitting holes 62 of the support frame 45 and the fitting holes 76 of the bulged cover 46 in the condition where the intake trap 55 is clamped between the support frame 45 and the bulged cover 46, the bulged cover 46 can be fitted to the support frame 45 (See also FIG. 6).

In the same manner as the intake trap 55, the breather trap 61 is a member in which a metal mesh net (not shown) is clamped between rectangular punching metals 63*a* (only the one on this side is shown). The punching metals 63*a* and the metal mesh net are fitted as one body by a frame body 63*b*. The breather trap 61 is provided between the breather 60 and the support frame 45, by fitting the breather 60 to the support frame 45 of the bulged portion 44. With the breather 60 provided on the support frame 45 of the bulged portion 44 with the breather trap 60 therebetween, a breather pipe extending from the engine can be opened into the bulged portion 44 through a pipe 60*a* of the breather 60.

Returning to FIG. 4, air is sucked into the bulged portion 44 through the suction port 72 formed in the lower portion 71 of the bulged cover 46. The air introduced into the bulged portion 44 is introduced into the box main body 42 through the intake trap 55 and the air intake port 67. The air introduced into the box main body 42 is led into the first to fourth intake pipes 35–38 through the respective inlets 35*c*–38*c* of the first to fourth intake pipes 35–38, and is introduced into the respective cylinders 18*a* (shown in FIG. 1) through the first to fourth intake pipes 35–38. In this case, since the intake trap 55 is provided in the bulged portion 44, dust and the like contained in air can be removed by the intake trap 55. On the other hand, if sparks flow into the side of the bulged cover 46, the sparks can be trapped by the intake trap 55 and the breather trap 61 (shown in FIG. 5).

Returning to FIG. 2, since the bulged cover 46 is bulged to the inside of the watercraft body 11 and the lower portion thereof is provided with the suction port 72, the suction port 72 can be disposed on the inside of the watercraft body 11. Therefore, the suction port 72 can be directed to the side of the engine 18, and the suction port 72 can be prevented from projecting to the outside. Therefore, if the personal watercraft 10 overturns, the resistance attendant on a movement of the suction port 72 in sea water at the time of returning the personal watercraft 10 from the overturned condition to the normal condition can be reduced. Accordingly, the personal watercraft 10 can be easily returned from the overturned condition to the normal condition.

FIG. 6 is a sectional view showing a major part of the personal watercraft according to the present invention, and shows the condition where the first to fourth intake pipes 35–38 are bent at their base portions 35*a*–38*a* and extend upwards with a rising gradient along the left side wall 30 on the lower side of the seat 17. The cover body 43 is disposed facing to the left side wall 30. The left side wall 30 facing to the cover body 43 is provided with the opening 31. The side cover 50 is detachably fitted to the opening 31. The fitting surface 47 of the box main body 42 for fitting the cover body 43 is formed to be substantially parallel to the left side wall 30. The support frame 45 is integrally formed at a front portion of the box main body 42 (namely, the fourth intake pipe 38). The bulged cover 46 fitted to the support frame 45 is bulged to the inside in the width direction of the watercraft body 11. Furthermore, the air suction port 72 is opened in the lower portion 71 of the bulged cover 46.

With the first to fourth intake pipes 35–38 bent at their base ends 35*a*–38*a* and extending upwards with a rising gradient along the left side wall 30 on the lower side of the seat 17, the inlets 35*c*–38*c* of the first to fourth intake pipes 35–38 can be located at positions higher than the base ends 35*a*–38*a*. Accordingly, even if sea water or water penetrates into the watercraft body 11, it can be ensured that the sea water or water does not easily reach the inlets 35*c*–38*c* of the first to fourth intake pipes 35–38. Therefore, it is possible to prevent the sea water or water from penetrating into the first to fourth intake pipes 35–38 through the inlets 35*c*–38*c* of the first to fourth intake pipes 35–38.

As shown in FIG. 3, the side cover 50 is a member such that a seal member 53 is fitted to the peripheral edge thereof excluding the upper end 52. The seal member 53 is laid on the left side wall 30. The front end of a bent portion 52*a* of the upper end 52 is mounted on a stepped portion 30*a* of the left side wall 30. In this condition, the side cover 50 is fixed to the left side wall 30 by bolts and nuts 54*a* and 54*b*. By detaching the side cover 50 from the left side wall 30 to open the opening 31, the cover body 43 can be easily detached from the box main body 42 by utilizing the opening 31. With the flanges 35*b*–38*b* (See also FIG. 7) provided at the base ends 35*a*–38*a* of the first to fourth intake pipes 35–38, the first to fourth intake pipes 35–38 can be fixed by pressing the flanges 35*b*–38*b* by the fixing member 68.

Figure 7:
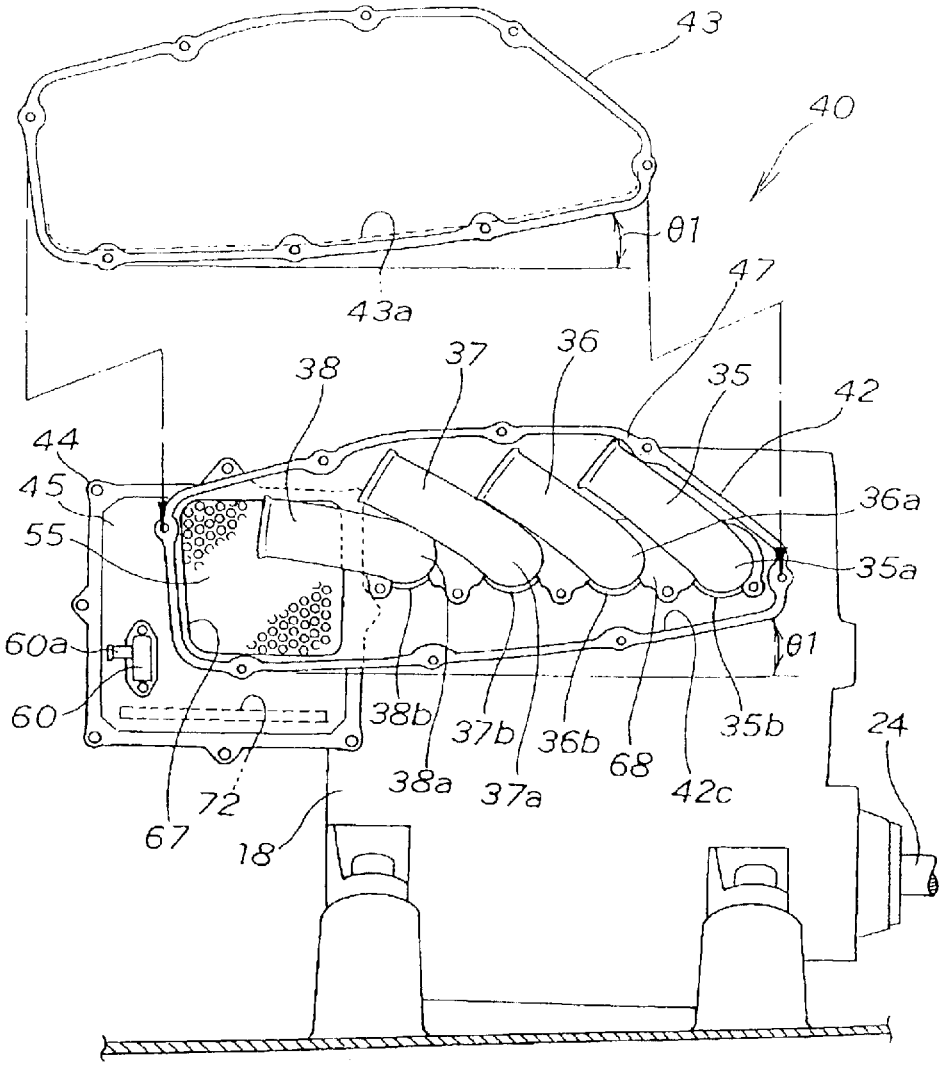
FIG. 7 is a side view showing a major part of the personal watercraft according to the present invention.

FIG. 7 is a side view showing a major part of the personal watercraft according to the present invention, and shows the condition where the cover body 43 is detached from the box main body 42. The air box 40 has a structure in which a lower surface 42*c* of the box main body 42 and a lower surface 43*a* of the cover body 43 have a descending gradient of an inclination angle θ1 towards the air intake port 67.

With the lower surface 42*c* of the box main body 42 and the lower surface 43*a* of the cover body 43 having the descending gradient of the inclination angle θ1 towards the air intake port 67, even if sea water or water penetrates into the air box 40, the sea water or water having penetrated into the air box 40 can be efficiently led along the lower surface 42*c* of the box main body 42 and the lower surface 43*a* of the cover body 43 to the air intake port 67 and caused to flow out through the air intake port 67 into the bulged portion 44.

Since the suction port 72 is provided at the lower portion 71 of the bulged portion 44, the sea water or water having flowed into the bulged portion 44 can be securely drained through the suction port 72 to the exterior of the bulged portion 44. Therefore, it is possible to prevent sea water or water from being accumulated in the air box 40 or in the bulged portion 44.

In addition, the lower surfaces 42*c* and 43*a* of the box main body 42 and the cover body 43 have a descending gradient of an inclination angle θ2 towards the inside of the watercraft body; namely, towards the air intake port 67 as shown in FIG. 6. Accordingly, the sea water or water present in the air box 40 can be efficiently led to the air intake port 67. Furthermore, the sea water or water having flowed into the bulged portion 44 can be drained through the suction port 72 to the exterior of the bulged portion 44 more securely.

With the first to fourth intake pipes 35–38 bent at their base ends 35*a*–38*a* along the left side wall 30 on the lower side of the seat 17 as described referring to FIG. 6, the first to fourth intake pipes 35–38 can extend upwards a large amount without projecting the left side wall 30 (shown in FIG. 6) on the lower side of the seat 17 to the outside.

Accordingly, the spacing S (shown in FIG. 2) between the left and right side walls 30 and 32 on the lower side of the seat 17 can be suppressed to a minimum, so that the driver can sit astride the saddle ride type seat 17 in a natural posture.

Figure 8:
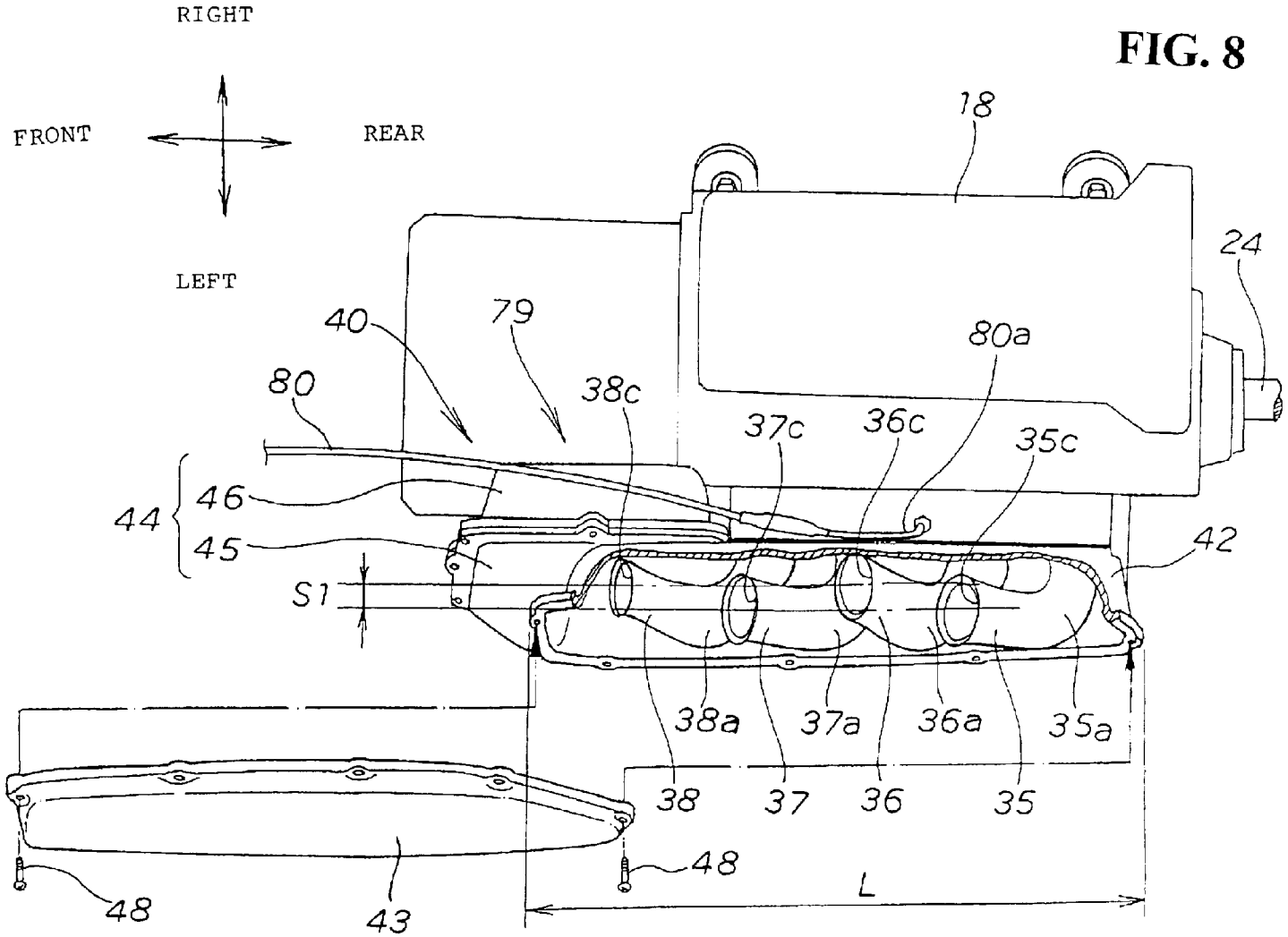
FIG. 8 is a plan view showing a major part of the personal watercraft according to the present invention.

FIG. 8 is a plan view showing a major part of the personal watercraft according to the present invention, and shows the condition where the cover body 43 is detached from the box main body 42. The first to fourth intake pipes 35–38 have their respective inlets 35*c*–38*c* so bent that they are arranged in a zigzag manner. Namely, the first and third intake pipes 35 and 37 are same-shaped tubes gradually bent at their base ends 35*a* and 37*a*, while the second and fourth intake pipes 36 and 38 are same-shaped tubes bent comparatively keenly at their base ends 36*a* and 38*a*.

With the first and third intake pipes 35 and 37 bent gradually and with the second and fourth intake pipes 36 and 38 bent comparatively keenly, the respective inlets 35*c* and 37*c* of the first and third intake pipes 35 and 37 can be disposed at positions away from the center 10*a* (See FIG. 2) of the personal watercraft 10, while the inlets 36*c* and 38*c* of the second and fourth intake pipes 36 and 38 can be disposed at positions close to the center 10*a* of the personal watercraft 10; namely, at positions spaced from the inlets 35*c* and 37*c* by a distance S1 toward the inside of the watercraft body 11. Accordingly, the respective inlets 35*c*–38*c* of the first to fourth intake pipes 35–38 can be arranged in a zigzag manner, and the inlets 35*c*–38*c* can be arranged densely.

Therefore, the box main body 42 for containing the first to fourth intake pipes 35–38 can be made compact; namely, the length L thereof can be suppressed to a minimum. Accordingly, the air box 40 can be disposed close to the center of the watercraft body 11 even if the first to fourth intake pipes 35–38 are ensured to be long and extend upwards a large amount. Therefore, the spacing S (shown in FIG. 2) between the left and right side walls 30 and 32 on the lower side of the seat 17 can be suppressed to a minimum, so that the driver can sit astride the seat 17 in a natural posture.

On the other hand, where the respective inlets 35*c*–38*c* of the first to fourth intake pipes 35–38 are arranged rectilinearly, the length L of the box main body is large. As a result, when it is intended, for example, to dispose the box main body close to the center of the watercraft body, a comparatively large space must be secured on the central side of the watercraft body. However, it is difficult to secure a comparatively large space on the central side of the watercraft body, so that the box main body would be disposed on the outside of the watercraft body. Therefore, the spacing between the left and right side walls on the lower side of the seat 17 cannot be suppressed to a minimum, and the driver cannot sit astride the seat 17 in a natural posture.

In addition, the air box 40 is provided with the bulged cover 46 bulged to the inside in the width direction of the watercraft body 11 (shown in FIG. 2) at a location on the front side of the fourth intake pipe 38. Therefore, the bulged cover 46 can be disposed in a space 79 on the front side of the engine 18, so that the bulged cover 46 does not interfere with the engine 18 even if the bulged cover 46 is bulged toward the inside in the width direction of the watercraft body 11; namely, toward the side of the engine 18.

Therefore, the bulged cover 46 can be disposed close to the side of the center 10*a* (shown in FIG. 2) of the personal watercraft 10, so that the spacing S between the left and right side walls 30 and 32 extending downwards from the lower side of the seat 17 can be suppressed to be small. Accordingly, the driver can sit astride the seat 17 in a natural posture.

A throttle valve 88 (shown in FIG. 9) is provided in the vicinity of an inner wall of the air box 40. The tip end 80*a* of a throttle cable 80 is connected to the throttle valve 88. Furthermore, the base end of the throttle cable 80 is connected to a throttle lever 81 (shown in FIG. 9) of the steering handle 16.

Figure 9:
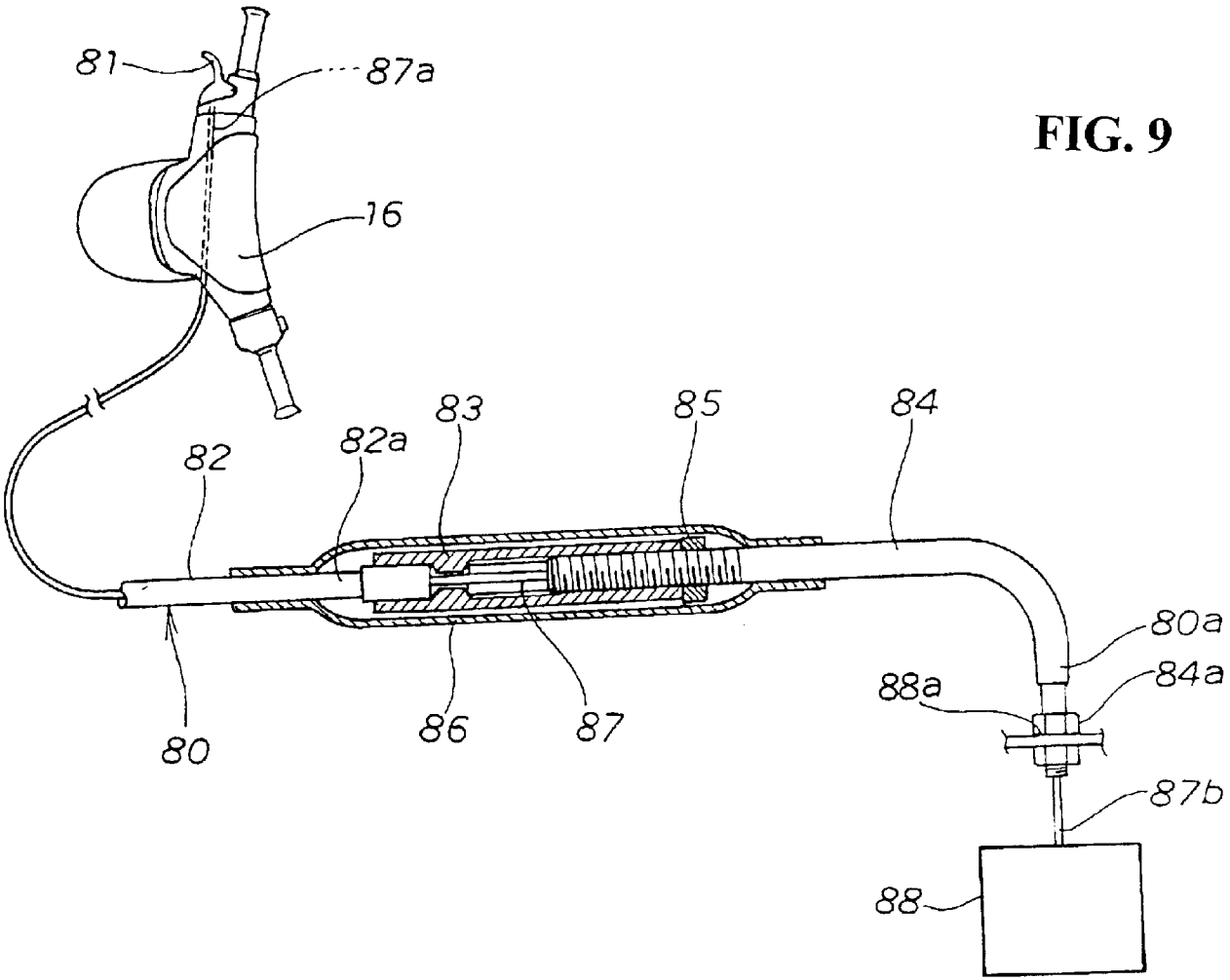
FIG. 9 is a sectional view showing a throttle cable of the personal watercraft according to the present invention.

FIG. 9 is a sectional view showing the throttle cable of the personal watercraft according to the present invention. The throttle cable 80 has a structure in which a connection portion 84 is connected to the tip end 82*a* of an outer case 82 through an adjusting nut 83. The adjusting nut 83 is locked by a lock nut 85. The lock nut 85 and the adjusting nut 83 are covered with a boot 86. An inner cable 87 is slidably fitted to the outer case 82, the adjusting nut 83 and the connection portion 84. The base end 87*a* of the inner cable 87 is connected to the throttle lever 81 of the steering handle 16. Furthermore, the tip end 87*b* is connected to a lever (not shown) of the throttle valve 88.

By loosening the lock nut 85 and rotating the adjusting nut 83, a connection position 84*a* of the connection portion 84 can be adjusted to a fitting position 88*a* of the throttle valve 88. By disposing the adjusting nut 83 on the upper side of the engine 18 as shown in FIG. 8, the adjusting nut 83 can be easily operated from the upper side of the engine 18. By connecting the throttle lever 81 to the lever of the throttle valve 88 by the throttle cable 80, it is possible to operate the inner cable 87 by the throttle lever 81, thereby controlling the lever of the throttle valve 88 so as thereby to adjust the quantity of an air-fuel mixture gas supplied to the respective cylinders.

Figure 10:
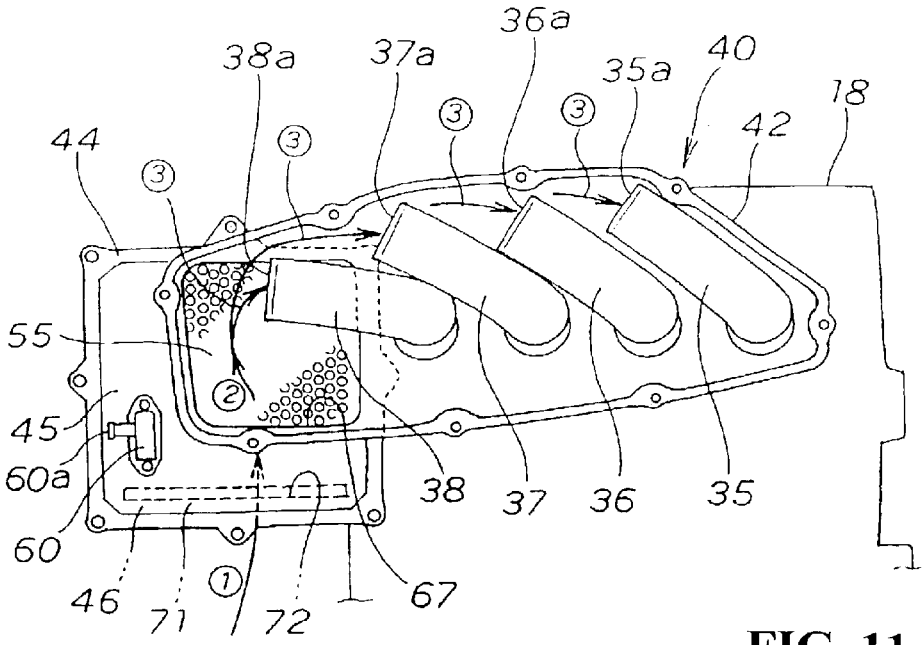
FIG. 10 is a first action illustration showing an action of the personal watercraft according to the present invention.

Actions of the personal watercraft will now be described with reference to FIGS. 10 to 12. FIG. 10 is a first action illustration showing an action of the personal watercraft according to the present invention, and shows the condition of sucking air in.

Air is sucked in through the suction port 72 formed in the lower portion 71 of the bulged cover 46 into the bulged portion 44 as indicated by arrow ①. The air sucked into the bulged portion 44 is led through the intake trap 55 to the air intake 67. The air led to the air intake 67 is introduced into the box main body 42 through the air intake 67 as indicated by arrow ②.

Since the air introduced into the bulged portion 44 passes through the intake trap 55, dust and the like contained in the air can be removed by the intake trap 55. Therefore, the air filtered and being clean can be introduced into the box main body 42. The air introduced into the box main body 42 is led through the respective inlets 35*c*–38*c* of the first to fourth intake pipes 35–38 into the first to fourth intake pipe 35–38 as indicated by arrow ③, and is introduced into the cylinders 18*a* (shown in FIG. 1) through the first to fourth intake pipes 35–38.

In this case, since the breather 60 is provided on the support frame 45 of the bulged portion 44 with the breather trap 61 (shown in FIG. 5) therebetween, the breather pipe extending from the engine can be opened into the bulged portion 44 through the pipe 60*a* of the breather 60.

Figure 11:
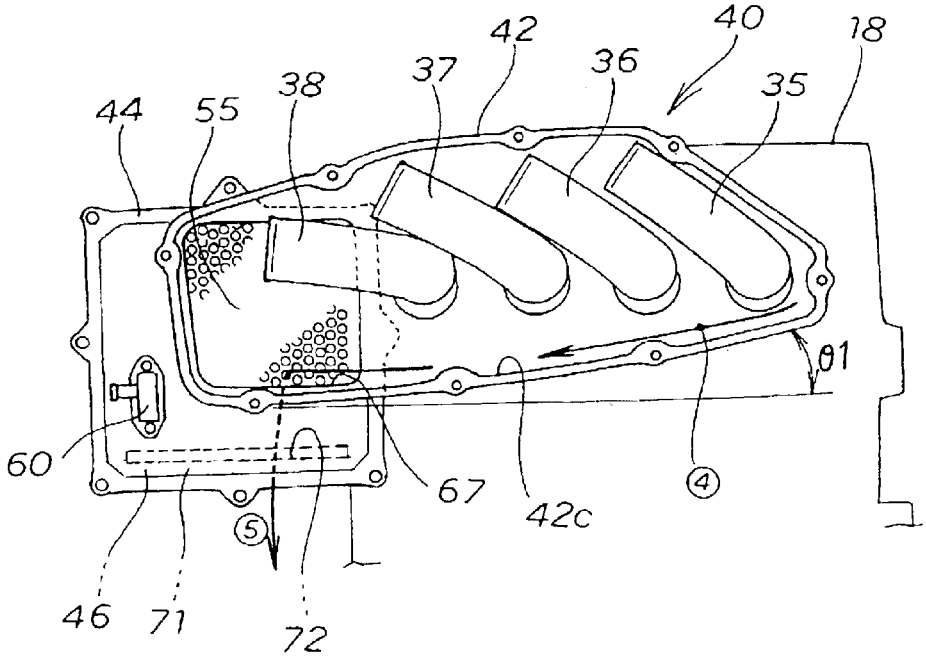
FIG. 11 is a second action illustration showing an action of the personal watercraft according to the present invention.

FIG. 11 is a second action illustration showing an action of the personal watercraft according to the present invention, and shows the condition of removing sea water or water having penetrated into the air box 40. The personal watercraft 10 shown in FIG. 1 might be overturned during an operation of the personal watercraft 10. If the personal watercraft 10 overturns, sea water or water may penetrate into the air box 40. When the personal watercraft 10 in this condition is returned to its normal position, the sea water would be accumulated on the lower surface 42*c* of the box main body 42 and the lower surface 43*a* (shown in FIG. 7) of the cover body 43.

With the lower surface 42*c* of the box main body 42 and the lower surface 43*a* of the cover body 43 having the descending gradient of the inclination angle θ1 toward the air intake port 67, the sea water or water in the air box 40 can be efficiently led along the lower surfaces 42*c* and 43*a* to the air intake port 67 as indicated by arrow ④, and can securely be made to flow out through the air intake port 67 into the bulged portion 44 as indicated by arrow ⑤. The sea water or water having flowed out into the bulged portion 44 can be securely drained through the suction port 72. Therefore, it is possible to prevent sea water or water from accumulating in the air box 40 or in the bulged portion 44.

In addition, with the lower surface 42*c* of the box main body 42 and the lower surface 43*a* of the cover body 43 having the descending gradient of the inclination angle θ2 toward the inside of the watercraft body 11 as shown in FIG. 6, the sea water or water in the air box 40 can be efficiently led to the air intake port 67. Furthermore, the sea water or water having flowed out through the air intake port 67 into the bulged portion 44 can be drained through the suction port 72 more securely.

Figure 12:
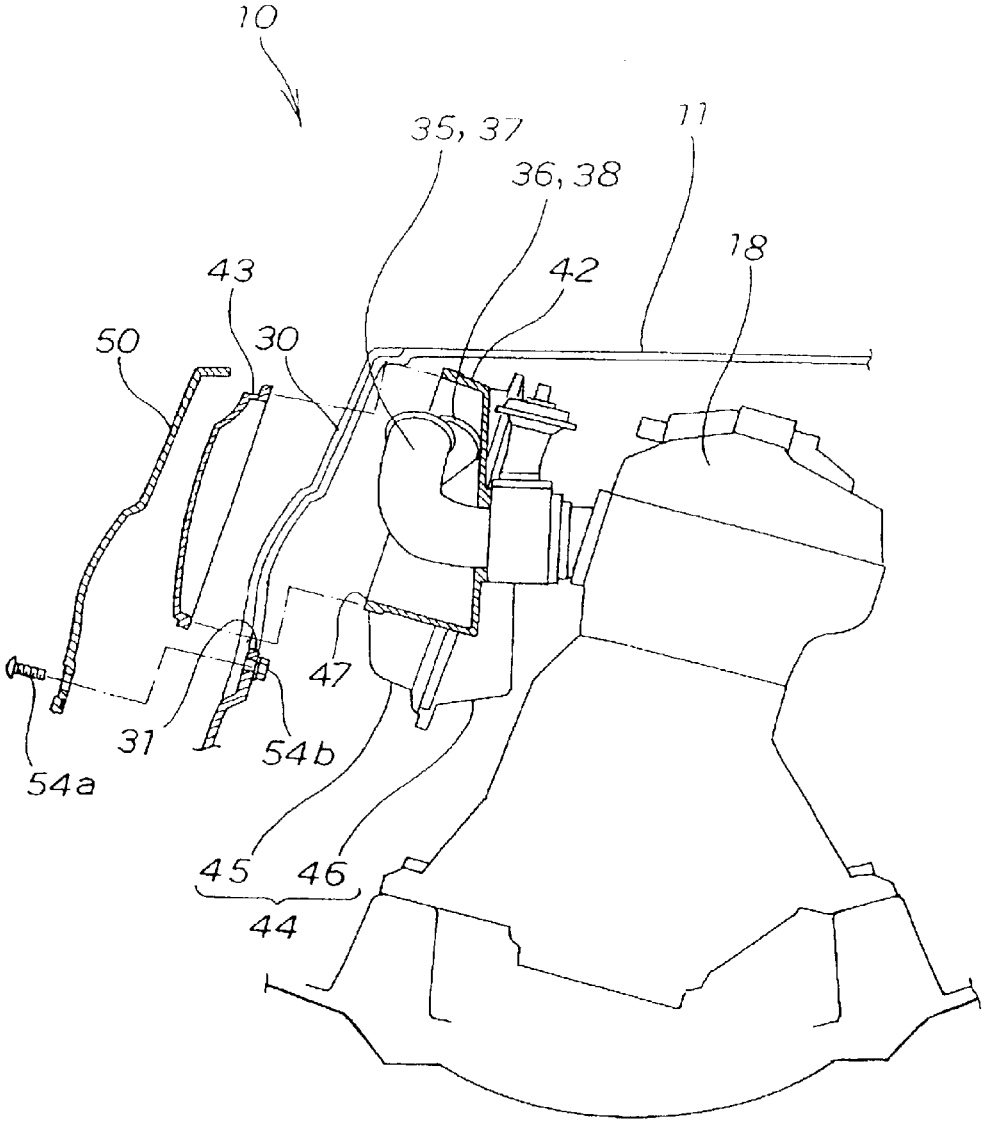
FIG. 12 is a third action illustration showing an action of the personal watercraft according to the present invention.
Figure 13:
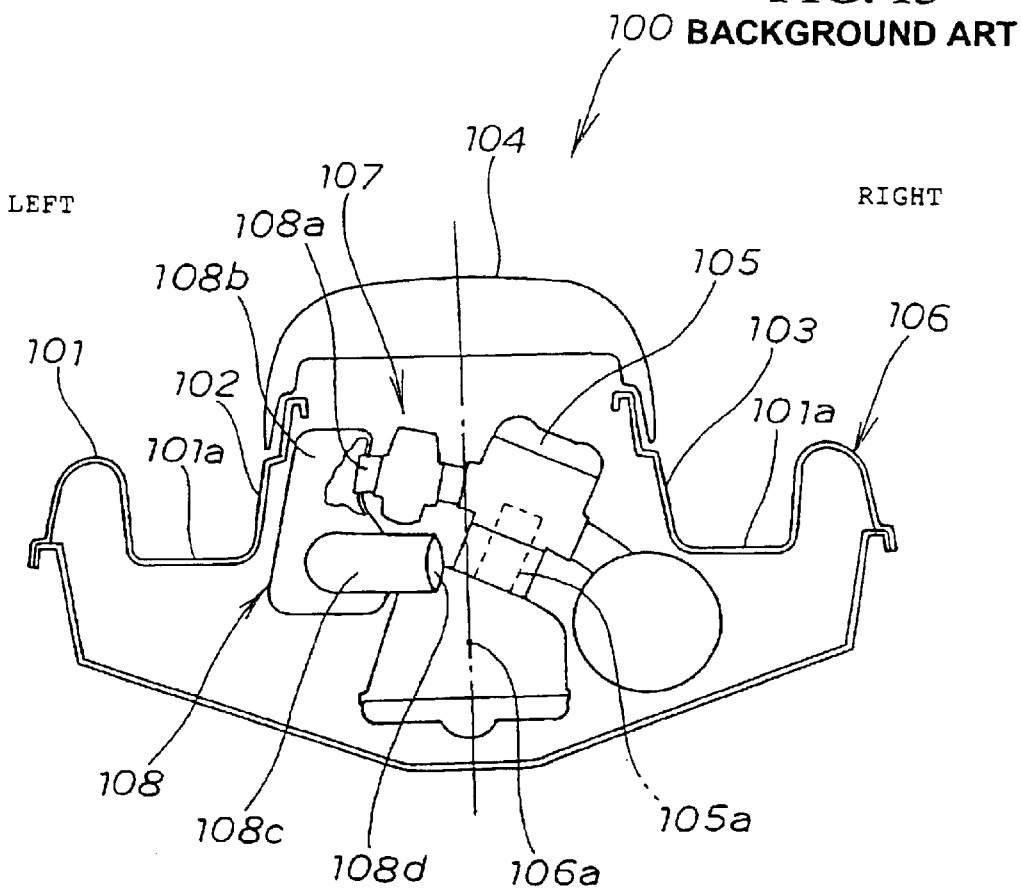
FIG. 13 BACKGROUND ART
FIG. 13 is a sectional view of a personal watercraft according to the background art.

FIG. 12 is a third action illustration showing an action of the personal watercraft according to the present invention, and shows the condition of, for example, performing maintenance or inspection of the first to fourth intake pipes 35–38 in the air box 40. With the opening 31 formed in the left side wall 30 facing to the cover body 43 and with the side cover 50 detachably fitted to the opening 31, it is possible to open the opening 31 by detaching the side cover 50 from the left side wall 30 and thereby to easily detach the cover body 43 from the box main body 42 by utilizing the opening 31, at the time of, for example, performing maintenance or inspection of the first to fourth intake pipe 35–38.

Since the cover body 43 is located at the side surface of the air box 40, it can be ensured that the cover body 43 is large in shape. Since the cover body 43 can thus be easily detached and a large opening can thus be opened in the box main body 42 by detaching the cover body 43, maintenance or inspection of the first to fourth intake pipes 35–38 in the air box 40 can be easily carried out.

In addition, since the fitting surface 47 of the box main body 42 fronts on the opening 31 of the left side wall 30 when the cover body 43 has been detached, the maintenance or inspection of the first to fourth intake pipes 35–38 in the air box 40 can be carried out more easily.

While an example in which four intake pipes are provided as the first to fourth intake pipes 35–38 has been described in the above embodiment, the present invention can be applied to an arbitrary number of intake pipes.

In addition, while the bulged portion 44 of the air box 40 has been provided at the front end portion 42*b* of the box main body 42 in the above embodiment, the bulged portion 44 may be provided at a rear end portion 42*a* of the box main body 42.

Furthermore, while an example in which the personal watercraft 10 is a jet propulsion watercraft propelled by a jet propeller has been described in the above embodiment, the propelling means of the personal watercraft is not limited to this.

The present invention, constituted as described above, displays the following effects.

According to the first aspect of the present invention, the intake pipes are bent along the side wall on the lower side of the seat, whereby the intake pipes can extend upwards a large amount without projecting the side wall on the lower side of the seat to the outside. Accordingly, the spacing between the left and right side walls on the lower side of the seat can be suppressed to a minimum, so that the driver can maintain a natural posture when he sits astride the saddle ride type seat and puts his feet on the foot rest portions of the deck.

In addition, since the intake pipes extend upwards a large amount, the inlets of the intake pipes can be disposed at high positions. Accordingly, even if sea water or water penetrates into the watercraft body, the sea water or water can be prevented from reaching the inlets of the intake pipes. Therefore, sea water or water can be prevented from penetrating through the inlets of the intake pipes into the cylinders.

According to the second aspect of the present invention, the inlets of the plurality of intake pipes are arranged in a zigzag manner, whereby the inlets of the respective intake pipes can be arranged densely with respect to the front-rear direction of the watercraft body. Therefore, the air box can be made compact, so that the air box can be disposed at a desired position in the watercraft body even where the intake pipes are extended upwards a large amount.

Therefore, the spacing between the left and right side walls on the lower side of the seat can be suppressed to a minimum, so that the driver can maintain a natural posture when he sits astride the saddle ride type seat and puts his feet on the foot rest portions of the deck.

According to the third aspect of the present invention, each of the intake pipes extends upwards, whereby the inlet of each of the intake pipes can be disposed at a high position. Accordingly, even if sea water or water penetrates into the watercraft body, it is possible to ensure that the sea water or water does not easily reach the inlet of each of the intake pipes. Therefore, it is possible to prevent the sea water or water from penetrating through the inlet of each of the intake pipes.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A personal watercraft comprising:

a watercraft body;

a saddle ride type seat at a roughly central portion of said watercraft body;

cover form side walls extending downwards from left and right lower edges of said seat;

an engine mounted on a lower side of said seat with an axis of a crankshaft thereof directed in a front-rear direction of said watercraft body;

a plurality of cylinders provided in said engine, said cylinders being arranged in the front-rear direction of said watercraft body; and intake pipes in communication with said cylinders, respectively, said intake pipes extending from a side surface of said engine, wherein each of said intake pipes is bent toward the front direction of said watercraft body along one of said side walls on the lower side of said seat, so that inlets of said intake pipes open toward the front direction of said watercraft body.

2. The personal watercraft according to claim 1, wherein said inlets of said intake pipes are arranged in a zigzag manner so that said inlets are arranged densely, and said intake pipes are surrounded by an air box disposed between said engine and said one side wall.

3. The personal watercraft according to claim 1, wherein each of said intake pipes extends upwards.

4. The personal watercraft according to claim 1, wherein said engine is inclined toward a left side or a right of the watercraft body about an axis of the crankshaft of the engine to form a space between the engine and one of the side walls, and said intake pipes are located within said space.

5. The personal watercraft according to claim 4, wherein said inlets of said intake pipes are arranged in a zigzag manner so that said inlets are arranged densely, and said intake pipes are surrounded by an air box disposed between said engine and said one side wall.

6. The personal watercraft according to claim 4, wherein each of said intake pipes extends upwards.

7. The personal watercraft according to claim 1, wherein said intake pipes are surrounded by an air box disposed between said engine and said one side wall.

8. The personal watercraft according to claim 7, wherein said air box further comprises:

a box main body attached to a side of said engine;

a cover body removably attached to said box main body; and a bulged portion provided at a front portion of said box main body, said bulged portion including a support frame formed integrally with said box main body and a bulged cover removably attached to said support frame.

9. The personal watercraft according to claim 8, wherein said box main body includes an air intake port formed therein and said bulged cover includes a suction port formed therein, said air box further comprising an intake trap located between said bulged cover and said support frame, said intake trap being located within an air flow path from said air suction port to said air intake port.

10. An intake pipe arrangement for a personal watercraft, the personal watercraft including a watercraft body, a saddle ride type seat at a roughly central portion of the watercraft body, cover form side walls extending downwards from left and right lower edges of the seat, an engine mounted on a lower side of the seat with an axis of a crankshaft thereof directed in a front-rear direction of the watercraft body, and a plurality of cylinders provided in the engine and arranged in the front-rear direction of the watercraft body, said intake pipe arrangement comprising:

intake pipes in communication with the cylinders of the engine, respectively, said intake pipes extending from a side surface of the engine, wherein each of said intake pipes is bent toward the front direction of the watercraft body along one of said side walls on the lower side of said seat, so that inlets of said intake pipes open toward the front direction of the watercraft body.

11. The intake pipe arrangement according to claim 10, wherein said inlets of said intake pipes are arranged in a zigzag manner so that said inlets are arranged densely, and said intake pipes are surrounded by an air box disposed between the engine and the one side wall.

12. The intake pipe arrangement according to claim 10, wherein each of said intake pipes extends upwards.

13. The intake pipe arrangement according to claim 10, wherein the engine is inclined toward a left side or a right of the watercraft body about an axis of the crankshaft of the engine to form a space between the engine and one of the side walls, and said intake pipes are located within said space.

14. The intake pipe arrangement according to claim 13, wherein said inlets of said intake pipes are arranged in a zigzag manner so that said inlets are arranged densely, and said intake pipes are surrounded by an air box disposed between the engine and the one side wall.

15. The intake pipe arrangement according to claim 13, wherein each of said intake pipes extends upwards.

16. The intake pipe arrangement according to claim 10, wherein said intake pipes are surrounded by an air box disposed between the engine and the one side wall.

17. The intake pipe arrangement according to claim 16, wherein said air box further comprises:

a box main body attached to a side of the engine;

a cover body removably attached to said box main body; and a bulged portion provided at a front portion of said box main body, said bulged portion including a support frame formed integrally with said box main body and a bulged cover removably attached to said support frame.

18. The intake pipe arrangement according to claim 17, wherein said box main body includes an air intake port formed therein and said bulged cover includes a suction port formed therein, said air box further comprising an intake trap located between said bulged cover and said support frame, said intake trap being located within an air flow path from said air suction port to said air intake port.

19. An intake pipe arrangement for a personal watercraft, the personal watercraft including a watercraft body, a saddle ride type seat at a roughly central portion of the watercraft body, cover form side walls extending downwards from left and right lower edges of the seat, an engine mounted on a lower side of the seat with an axis of a crankshaft thereof directed in a front-rear direction of the watercraft body, and a plurality of cylinders provided in the engine and arranged in the front-rear direction of the watercraft body, said intake pipe arrangement comprising:

intake pipes in communication with the cylinders of the engine, respectively, said intake pipes extending from a side surface of the engine, wherein each of said intake pipes is bent along one of said side walls on the lower side of said seat, and wherein said inlets of said intake pipes are arranged in a zigzag manner so that said inlets are arranged densely, and said intake pipes are surrounded by an air box disposed between the engine and the one side wall.

* * * * *